United States Patent [19]

Schaller

[11] 4,336,834

[45] Jun. 29, 1982

[54] VENETIAN BLIND

[75] Inventor: Maurice Schaller, Clifton, N.J.

[73] Assignee: Levolor Lorentzen, Inc., Lyndhurst, N.J.

[21] Appl. No.: 863,313

[22] Filed: Dec. 22, 1977

Related U.S. Application Data

[63] Continuation of Ser. No. 741,951, Nov. 15, 1976, abandoned.

[51] Int. Cl.[3] ..... E06B 9/30

[52] U.S. Cl. ..... 160/168 A; 160/236

[58] Field of Search ..... 160/166–178, 160/236

[56] References Cited

U.S. PATENT DOCUMENTS 2,074,482 3/1937 Martens ..... 160/236
2,325,003 7/1943 Beckwith et al. ..... 160/236
2,534,673 12/1950 Holland ..... 160/236
2,572,957 10/1951 Shaw ..... 160/173

*Primary Examiner*—Peter M. Caun

[57] ABSTRACT

A Venetian blind is described having slats which have a selected color on one face and a lighter neutral, pastel or substantially white color on the reverse face, with string type ladders, one string of each ladder being colored to blend with the darker colored faces of the slats and the other string thereof being of the lighter color to blend with the lighter colored face of the slats. The cross rungs are also longitudinally colored in part in the same color as the darker colored string and the lift cord is of the same color as the darker colored string, so that when the blind is in the closed or partially closed position with the darker colored faces of the slats on one side of the blind, the strings of the ladders and lift cords blend with the colored surfaces of the slats on that side and are substantially unnoticeable.

6 Claims, 10 Drawing Figures

VENETIAN BLIND

This is a continuation of application Ser. No. 741,951, filed Nov. 15, 1976, now abandoned.

BACKGROUND OF THE INVENTION

It is known in the Venetian blind art to provide blinds having slats of different colors. Thus slats having one color and/or design on one side and another color and/or design on the reverse side have been used, particularly where decorator colors are desired to enhance the appearance of a room or office.

When colored slats are employed, it is generally desired to have the colored portion appear primarily on the inside of the room, the outside of the blind being of a light, neutral, off-white or pastel color so that when the building is viewed from the outside all blinds will be of a uniform color, although flexibility of color decor is retained on the inside of the blind.

It is also known that architects and building owners, desiring to have a uniform outside appearance of a building or wishing to match various structural portions of the building, or to create a distinctive body of color for a portion of the building, will specify that a certain color be included on the exterior exposed surfaces of the blinds.

In the past, it has also been known to use with colored slats a "string" type supporting ladder of the same color as the contrasting colored surfaces of the slats. However, when one side of the strings of the ladders are colored and the faces of the slats contacting the same are of another color or substantially white or off-white, it has been found that there is a tendency for the color in the ladders to migrate to the light colored surfaces of the slats and discolor the same, either during use or shipping when the ladder strings are bunched up. This obviously results in an unsightly appearance if the blind is reversed for any reason or if the blind is closely viewed from the outside of the building, as for example from a patio, the front of a house or a street level window in a commercial establishment. Also the appearance of a colored ladder against a different outside color is objectionable.

In view of the foregoing problem, it became customary practice to use white ladders, regardless of the color decor on the slats, which is often objectionable to decorators who wish the blind generally to present the appearance of one continuous color or at least not show a pronounced vertical white string or stripe which may interfere with the decor of the room.

SUMMARY OF THE INVENTION

The present invention overcomes the foregoing problems by providing a Venetian blind having a succession of colored slats wherein the surfaces of one side of the slats are of a light color or substantially neutral, i.e., white or off-white, and the surfaces on the reverse side of the slats are of a darker contrasting color and which employs string type ladders which are so colored as to blend with each of the colored surfaces of the slats, respectively, and render the strings substantially unnoticeable when the blind is in a closed or partially closed position.

More specifically, only one side of each set of the vertical strings is colored, preferably with a matching color or color which will blend with the color generally exposed to the side of the window to which the color is desired; and the other opposed set of vertical strings are of a light color or substantially white. This permits the blind to meet the requirements of decorators and architects with respect to the inside of the room or outside of the building and further avoids the problem of color migration with respect to the light colored surfaces of the blind, since no dark colors are employed on the surfaces of the slats which will be in contrast with the light colored strings, and therefore no objectionable color migration to the light colored surfaces of the slats is possible.

The rungs or cross-members of the ladders are also of a darker color in part, the color extending from the one set of the darker colored vertical strings to about one half to three quarters the length of the rungs and terminating in a lighter or neutral color on the other vertical strings. The provision of such colored rungs further cooperates with the blind when it is in a partially opened position to mask exposed ends of the rung and blend the same with the colored slats; whereas otherwise completely colored or completely white rungs would be noticeable. The colored and white portions of the rungs also cooperate with the slats of the blind when they are in their respective closed positions, as a portion of the lift cord slots in the slats and the underlying rung portions not covered by the overlapping slats will be visible but blend with the colored slats. It is also important that the dye used to color the rungs not extend entirely across the rung since a certain amount of the dye may then bleed into the light colored string of the ladder and thereby present an unsightly appearance, also possibly resulting in color migration to the lighter surfaces of the slats.

The lift cords are also preferably of the same color as the darker colored strings of the ladders to blend in with the darker colored surfaces of the slats for the same reasons as above indicated.

The invention will be better understood by the following description of the preferred embodiment thereof in relation to the accompanying drawings of which the following is a brief description, and wherein the dimensions are exaggerated in some instances for illustrative purposes. It should be understood, however, that although the invention is described with respect to a blind having light and darker colors on each sides of the slats, respectively, the darker color being faced to the inside of the room, the darker color may be faced to the outside of the room to meet the requirements of decorators and architects as described. The invention will be more particularly described with respect to preferred embodiments wherein the blind is so colored that the predominantly darker colored portion of the slats is faced toward the inside of the room.

DETAILED DESCRIPTION OF THE INVENTION

Figure 9:
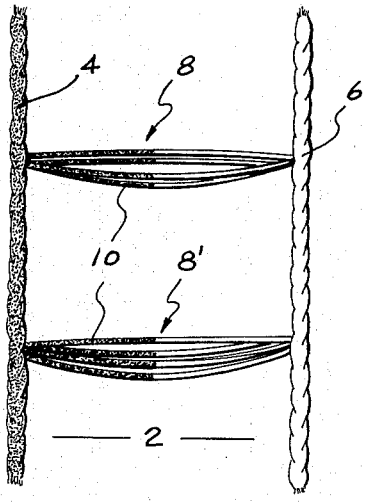
FIG. 9 is a more detailed side elevational view of a preferred construction of a string ladder used in accordance with this invention.

The Venetian blind ladder employed in the present invention is generally indicated by 2 in FIG. 9 and is of the type that is known in the trade as a "string" ladder. The front and rear vertical supporting members of the ladder 4 and 6 respectively are cordlike and are braided and preferably constructed of polyester fibers. The rungs of cross members 8 and 8' of each ladder is comprised of a plurality of separate stringlike or threadlike strands which lie along side of one another and interwoven with the supporting members 4 and 6. The strands are shown in FIG. 9 in a more or less separated position merely for illustrative purposes, but in actual practice the strands generally lie close to one another and often give the appearance of a single string rather than a plurality of strands.

Figure 10:
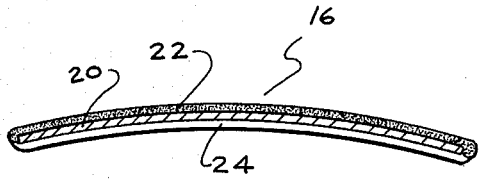
FIG. 10 is a side elevational view from one end of a Venetian blind slat showing one manner of disposition of the colored surfaces thereon; the other end being the same in reverse.

It is an essential feature of the present invention that a portion of the ladder structure be colored and the remainder be uncolored or neutral, i.e. pastel colored white or off-white. Thus, as shown in FIG. 9 and other of the figures the front string 4 is dyed in a distinctive color to match or blend with a corresponding color applied to one surface of the blind slats, as for example as shown in FIG. 10. The rear or outer string 6 is undyed and of a neutral, i.e. pastel color, white or off-white color as also shown in FIG. 9. The rungs are also dyed in part with the same color used for string 4, the colored portion being shown at 10 and extending from the front or inner string 4 up to from about $\frac{1}{2}$ to $\frac{3}{4}$ the length of rungs 8 and 8' for reasons previously pointed out.

Figure 1:
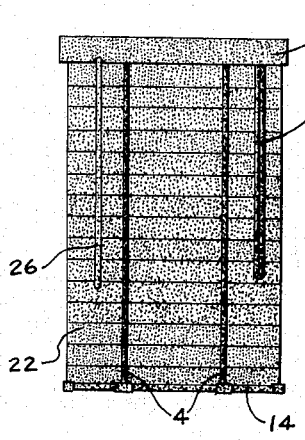
FIG. 1 is a front elevational view of a Venetian blind according to this invention showing the slats with the room edge of the slats tilted down in a closed position, the upper exposed convex surfaces of the slats being colored and the front strings of the ladder supporting the slats, and the lift cord being of similar color.

The ladders 2 of FIG. 9 are suspended from an upper supporting channel 12 of FIG. 1 and terminate in a bottom bar or rail 14, by means known in the art, the rungs 8 and 8' (FIG. 9) supporting slats generally indicated at 16 (FIG. 10) in a conventional manner. A lift cord 18, shown particularly in FIGS. 1 and 3 and passing through appropriate slots (not shown) in the slats 16, is affixed to bottom bar 14, thus permitting the blind to be elevated or lowered as desired.

Figure 2:
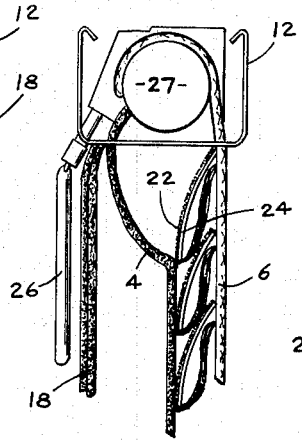
FIG. 2 is a right side elevational view thereof, showing the lower concave surfaces of the slats of a light color, the upper convex surfaces being of a darker contrasting color as in FIG. 1, the rungs of the ladder in part being of the darker color which extends along a portion thereof, the balance of the rungs being of the lighter color, and the rear strings of the ladder being of the ligher color similar to that of the lower surfaces of the slats, the lift cords being omitted for simplicity of illustration; the left side elevational view being the same in reverse.
Figure 3:
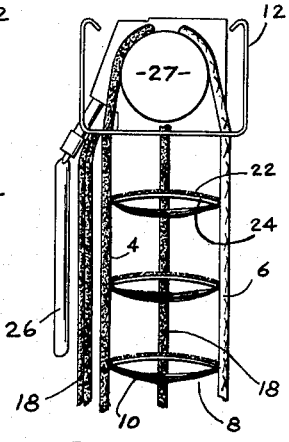
FIG. 3 is a right side elevational view thereof showing the slats in a horizontal position and the lift cords passing through the center portion thereof.

The embodiment of FIGS. 1–4 shows a preferred form of this invention wherein the slats 16 are provided with a neutral white color on the lower concave surfaces thereof and a darker contrasting color on the upper convex surfaces thereof as shown in FIGS. 2 and 3 and especially in FIG. 10. In this embodiment the blind is designed to present a continuous color, preferably a bright color, to the inside of the room when the slats are in the closed or partially closed positions, the inner string 4 of the ladder and the exposed portion of the lift cord 18 being of a matching or similar color, so that the strings and cords blend with the color on the slats. This is shown particularly in FIG. 1 wherein the strings 4 of the two ladders illustrated and lift cord 18 are shown to be of the same color as the exposed surfaces of the slats shown in FIG. 1. The diameters of strings 4 and lift cord 18 as shown in FIG. 1 and the other figures are somewhat enlarged for illustrative purposes.

Figure 4:
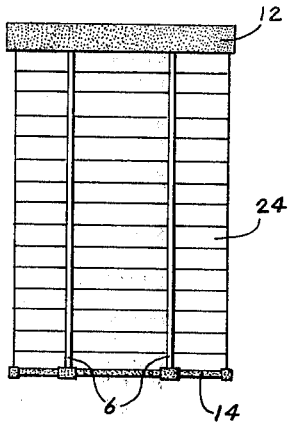
FIG. 4 is a rear elevational view thereof showing the slats in the same closed position as in FIG. 1, the lower exposed concave surfaces thereof being of a light color and the rear strings of the ladder being of similar color.

In the same embodiment, the reverse or outside of the blind shown in FIG. 4 exposes the lower concave surfaces of the slats to the outside of the window, these lower surfaces being of a neutral color as previously described. The enlarged view of the slat 16 shown in FIG. 10 illustrates more specifically the manner of coloring a metallic slat 20, preferably an aluminum slat of about 0.010 inch in thickness, with an upper colored portion 22 on the convex surface and a lower light colored, preferably neutral to white portion 24 on the concave surface.

When the blind is viewed from the outside of the building as in the view of FIG. 4 it will present a continuous light surface and the outer strings 6 of the supporting ladders will blend with such surfaces and be substantially unnoticeable. The colored head channel 12 and bottom rail 14 are usually hidden by the window sash and bottom frame of the window.

When the blind is partially opened moreover, the outer white strings 6 of the ladders will be substantially unnoticeable from the inside of the room and the lift cords extending through the slats, because of their matching color, will also be substantially unnoticeable from the inside of the room. In addition, the rungs will also be substantially unnoticeable since the colored portion of each rung of the ladders as represented at 10 in FIG. 9 will extend a sufficient distance beneath the slats of the blind so that no white portion will be significantly visible.

In accordance with this invention, it is preferred that the blind be so designed that the slats may be tilted from a closed position only to a substantially horizontal position as shown in FIGS. 2 and 3. The tilting may be accomplished in a number of ways but is preferably done by means of a tilt wand 26 operating through a known mechanism 27 not specifically shown to manipulate the strings of the ladders as required to position the slats in any position from closed to horizontal. This may be achieved by the mechanism described in U.S. Pat. No. 3,828,838; or by using a more conventional mechanism and simply tilting the slats to a horizontal position. In this manner the brighter colored surfaces of the slats will be more visible in all positions. The operator of the blind permits the slats to be tilted so that only the decorator color is seen from the interior or exterior as desired preferably so that only a neutral white is seen from the exterior. This is not accomplished just by using one-half of the tilting cycle. The blinds are permitted to operate through a certain range of degrees. The limit positions depend upon whether the windows are near street level or on upper floors, or whether the outside observers are on the street level or on certain floors of opposite buildings. Sun angles are also considered. Naturally, a compromise must be established if there is a conflict of interests. In addition, personal preferance as to what might be a desired limit for the occupant is considered.

FIGS. 5–8 show another embodiment of the present invention in which the upper convex surfaces of the slats 16 are of a neutral or light color and the lower concave surfaces are of a darker contrasting color. This is essentially the reverse of the disposition of colors shown in FIG. 10.

Figure 5:
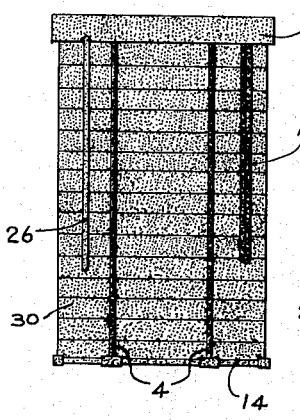
FIG. 5 is a front elevational view of another embodiment showing the slats in a closed position opposite to that shown in FIG. 1 with the room edge of the slats tilted up, the lower exposed concave surfaces of the slats now being visible and colored and the front strings of the ladder supporting the slats, and the lift cord being of similar color.
Figure 6:
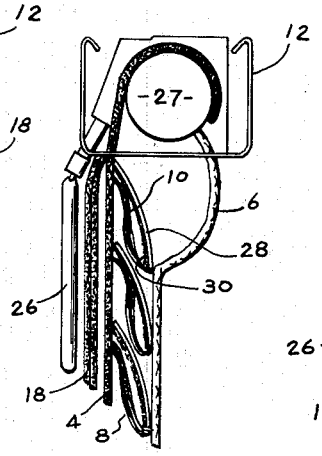
FIG. 6 is a right side elevational view thereof, showing the lower concave surfaces of the slats colored as in FIG. 5, the upper convex surfaces being of a lighter color, the rungs of the ladder in part being of the darker of the two colors which extends along a portion thereof and the rear strings of the ladder being of a lighter color similar to that of the upper surfaces of the slats, the lift cords being omitted for simplicity of illustration; the left side elevational view being the same in reverse.
Figure 8:
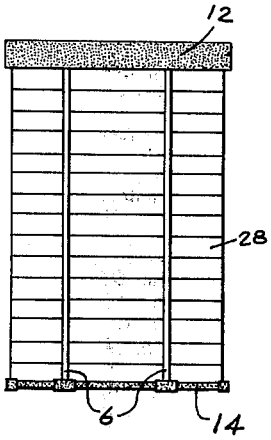
FIG. 8 is a rear elevational view of the embodiment of FIG. 5 showing the slats in the same closed position as in FIG. 5, the upper exposed convex surfaces thereof being of a light color and the rear strings of the ladder being of similar color.

In this case, the lower colored concave surfaces are shown disposed towards the room side of the blind as in FIG. 5, ladder strings 4 and lift-cord 18 matching or blending with the color on the lower surfaces of the slats. The blind is shown in FIG. 5 in the closed position as it is in side elevational view FIG. 6, wherein the upper neutral colored surfaces are represented by 28 and the lower darker colored surface by 30. The outside of the blind exposed toward the window side is shown in FIG. 8 wherein the upper netural or light colored surfaces are exposed to the outside and the outer strings 6 of the ladders are of a similar color blending with the color on the upper convex surfaces of the slats.

Figure 7:
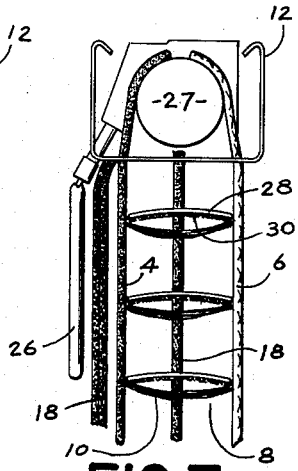
FIG. 7 is a right side elevational view thereof showing the slats in a horizontal position and the lift cords passing through the center portion thereof.

The same embodiment is shown with the slats in a substantially horizontal position in FIG. 7. As in the case of the embodiment previously described, it is also preferred that in this embodiment the blind be adjustable froms the closed position of FIG. 6 to a substantially horizontal position of the slats as shown in FIG. 7 in order to achieve the maximum color effect on the inside of the room. Thus when the blind is closed or partially closed the darker color on the lower concave surfaces of the slats 16 will be more visible toward the room and the lighter portions of the ladders and rungs will not be especially noticeable if at all.

Having thus described the invention it should be clear that resort may be had to such modifications and equivalents as fall within the spirit of the invention and the scope of the claims hereinafter made.

What is claimed is:

1. A Venetian blind comprising an upper supporting housing having means for independently tilting and elevating a plurality of slats having concave and convex surfaces suspended therebeneath on ladders, each ladder being provided with two vertical braided strings, one disposed on the inside and the other on the outside of the slats and string-like cross-rungs connected to the respective strings for supporting the slats, the ladder terminating in a bottom bar; each slat being provided with slots for receiving a lift cord, a light colored surface on one face thereof and a contrasting darker colored surface on the other face thereof; the vertical strings of the ladders on one side of the blind being of a light color substantially blending with the light colored surfaces of the slats and the vertical strings of the ladder on the other side of the blind being of the contrasting darker color to blend with a similar color on the other surfaces of the slats; the cross-rungs connecting the respective strings of each ladder also being of the same contrasting darker color extending from the darker colored string up to from about one/half to three/quarters the length of each cross-rung; and a lift cord of the same darker contrasting color passing through the slots in the slats; whereby when the blind is in the closed and partially closed positions with the darker contrasting colored surfaces on one side of the slats with the lighter colored surfaces on the other side thereof the darker vertical strings of the ladders and the lift cord will be substantially unnoticeable and blend with the darker colored surfaces of the slats and the lighter strings of the ladder will blend with the lighter surfaces of the slats.

2. A Venetian blind according to claim 1, wherein the top convex surfaces of the slats are substantially white and the bottom concave surfaces are of a contrasting color.

3. A Venetian blind according to claim 1, wherein the bottom concave surfaces of the slats are substantially white and the top convex surfaces thereof are of a contrasting color.

4. A Venetian blind according to claim 1, wherein the darker colored surfaces of the slats are normally exposed to the inside of a room in the closed positions, and the lighter colored surfaces are normally exposed to the outside of a room in said positions.

5. A Venetian blind according to claim 1, wherein the darker colored surfaces of the salts are disposed on the upper convex surfaces thereof and normally exposed to the inside of a room, and the lighter colored surfaces of the slats are disposed on the lower concave surfaces thereof and normally exposed to the outside of a room.

6. A Venetian blind according to claim 1, wherein the darker colored surfaces of the slats are disposed on the lower concave surfaces thereof and normally exposed to the inside of a room, and the lighter colored surface of the slats are disposed on the upper convex surfaces thereof and normally exposed to the outside of a room.

* * * * *